US005531442A

United States Patent [19]

Gill

[11] Patent Number: 5,531,442

[45] Date of Patent: Jul. 2, 1996

[54] HOCKEY PUCK WITH INTEGRAL ROLLERS AND METHOD OF ASSEMBLY

[75] Inventor: John M. Gill, St. Louis Park, Minn.

[73] Assignee: Sun Hockey, Inc., Edina, Minn.

[21] Appl. No.: 366,371

[22] Filed: Dec. 29, 1994

Related U.S. Application Data

[63] Continuation of Ser. No. 247,502, May 23, 1994, abandoned, which is a continuation of Ser. No. 555,075, Jul. 18, 1990, abandoned.

[51] Int. Cl.[6] ..... A63B 67/00

[52] U.S. Cl. ..... 273/128 R; 446/121

[58] Field of Search ..... 273/128 R, 128 A; 16/18; 193/35 MD; 446/120, 121

[56] References Cited

U.S. PATENT DOCUMENTS

| | | | |
|---|---|---|---|
| 2,444,810 | 7/1948 | Creasy . | |
| 2,727,744 | 12/1955 | Watson . | |
| 2,808,681 | 10/1957 | Arenstein | 446/120 X |
| 3,117,788 | 6/1959 | Buonanno et al. . | |
| 3,206,210 | 9/1965 | Bard . | |
| 3,444,973 | 5/1969 | Nygren | 193/35 MD |
| 3,523,384 | 8/1970 | Adelsohn | 446/121 |
| 3,559,802 | 2/1971 | Eidus | 206/56 |
| 3,590,970 | 7/1971 | Kornylak | 193/35 MD X |
| 3,675,928 | 7/1972 | Gentile . | |
| 3,682,284 | 8/1972 | Sakamoko | 193/35 MD |
| 3,704,891 | 12/1972 | Chiarelli . | |
| 3,762,711 | 10/1973 | Cooper . | |
| 3,784,204 | 1/1974 | Felber . | |
| 3,865,377 | 2/1975 | Cooper et al. . | |
| 3,941,381 | 3/1976 | Trbovich . | |
| 3,997,164 | 12/1976 | White, Sr. | 273/128 R |
| 4,078,801 | 3/1978 | White, Sr. . | |
| 4,111,419 | 9/1978 | Pellegrino . | |
| 4,153,253 | 5/1979 | White, Sr. . | |
| 4,183,536 | 1/1980 | Platt . | |
| 4,408,761 | 10/1983 | McAllister | 273/128 R X |
| 4,579,538 | 4/1986 | Bass et al. | 446/120 X |
| 4,754,973 | 7/1988 | Kunick . | |
| 4,793,769 | 12/1988 | Dolan . | |
| 4,801,144 | 1/1989 | De Masi, Jr. et al. | 273/128 R |
| 4,846,475 | 7/1989 | Newcomb et al. . | |
| 4,860,875 | 8/1989 | Couwenbergs | 193/35 MD |

FOREIGN PATENT DOCUMENTS

| | | | |
|---|---|---|---|
| 446956 | 3/1948 | Canada . | |
| 527738 | 7/1956 | Canada . | |
| 899395 | 5/1972 | Canada . | |
| 2316985 | 7/1975 | France . | |
| 2446475 | 4/1976 | Germany | 446/121 |
| 2838189 | 9/1978 | Germany . | |

*Primary Examiner*—Paul E. Shapiro
*Attorney, Agent, or Firm*—Moore & Hansen

[57] ABSTRACT

A hockey puck having integral rollers for use on hard surfaces other than ice. The rollers of the hockey puck, which are captured within and project from both sides of the main body thereof, enable the device to roll across various hard surfaces, overcoming the frictional forces that inhibit the sliding of conventional hockey pucks across surfaces other than ice. The two halves of the puck are securely fastened together using elastic snap members that simplify assembly of the puck while assuring greater reliability and durability.

5 Claims, 1 Drawing Sheet

HOCKEY PUCK WITH INTEGRAL ROLLERS AND METHOD OF ASSEMBLY

This is a continuation of application Ser. No. 08/247,502, filed May 23, 1994, abandoned, which is a continuation of application Ser. No. 07/555,075, filed Jul. 18, 1990, abandoned.

BACKGROUND OF THE INVENTION

1. Technical Field

The present invention relates generally to pucks for use in the game of hockey, and more particularly to pucks for use on non-ice surfaces such as roads or gym floors.

2. Background Information

Ice hockey, as its name implies, is conventionally played on outdoor ice rinks in northern climes, or on indoor ice rinks in more widespread regions. However, the use of outdoor ice rinks is limited by the change of seasons, and the use of indoor ice rinks may be limited by the expense of ice time. With the recent proliferation of in-line roller skates that may be used on hard, dry surfaces to simulate the performance of ice hockey skates, demand has increased for a hockey puck usable on hard, dry surfaces that more closely simulates the performance of an ice hockey puck. While attempts have been made by others to create such a hockey puck, none have come close enough to simulating the characteristics of weight, durability and slidability exhibited by a true ice hockey puck.

For example, one early attempt to develop what is sometimes called a road hockey puck was essentially a felt slab in the shape of disk, similar to a hockey puck. However, such pucks slide on dry pavement only for very short distances, and the lighter weight and springier material of the puck causes shots taken by the players to have far different characteristics than those taken using a hard rubber ice hockey puck.

To simulate more closely the weight of ice hockey pucks, road hockey pucks were developed having small weights inserted within the puck itself, as taught by U.S. Pat. No. 3,704,891 issued to Chiarelli on Dec. 5, 1972. These pucks were adequate for use by hockey players who simply wanted to practice their shots, but still failed to emulate on dry surfaces the performance of an ice hockey puck.

To simulate more closely the slidability of ice hockey pucks, road hockey pucks were developed that included small bearings or rollers. One early rendering of this type of puck is illustrated by U.S. Pat. No. 3,784,204 issued to Felber on Jan. 8, 1974. The puck taught in the '204 reference incorporated twelve different rollers, with six located on each face of the puck. The large number of rollers greatly increased the likelihood that a defect—such as a broken roller, dirt lodged in a roller socket, a roller becoming displaced from a socket and lost, etc.—could inhibit the performance of the puck or render it ineffective.

Pucks having rollers that project through both sides of the body of the puck have long been known, an example of which is illustrated in U.S. Pat. No. 3,865,377 issued to Cooper et al. on Feb. 11, 1975. The pucks shown therein, having one roller captured within a pair of spaced, parallel, annular ring members, are of only limited usefulness as they tend to be unstable, wobbling about the portion of the roller in contact with the surface on which it is rolling or sliding.

More recently, two patents have issued that illustrate the current trend in roller hockey pucks. U.S. Pat. Nos. 4,793,769 issued to Dolan on Dec. 27, 1988, and 4,801,144 issued to De Masi, Jr. et al. on Jan. 31, 1989, each show pucks having three rollers captured within and projecting from a hard disk portion. The '769 reference comprises a disk containing three bores into which the rollers are inserted and a pair of retaining plates glued to the disk for holding the rollers in the bores. The process of assembling this puck includes several steps, including precisely positioning the retaining plates relative to the disk to assure proper operation of the puck. Further, should the glue come undone, it is difficult to repair the puck to its original level of performance.

The '144 reference, on the other hand, comprises two half sections, each containing a set of three hemispherical depressions into which the rollers are placed before the halves are fastened. together. The halves are fastened together by screws, which frequently become loose, the heads of which may project from the body of the puck, increasing the risk of injury to the users or damage to the surface on which the puck is being used, especially if the puck is being used on an indoor floor. The '144 reference suggests a diameter of 1.125 inches for the rollers placed within the puck. Given a puck body height of one inch, the amount of roller projecting from the top and bottom of the puck body usually is inadequate for proper puck travel across the surface on which it is being used. Further, the commercial embodiment of this device includes weights inserted into the puck to help it more closely simulate a true ice hockey puck. The addition of weights increases the number of steps needed for assembly of the roller puck, and increases the possibility of defects in workmanship.

SUMMARY OF THE INVENTION

The invention includes two half sections made of a material having a resiliency similar to that of ice hockey pucks. Each half includes three chambers for receiving the rollers, the chambers being in the shape of a truncated hemisphere, permitting the rollers to extend beyond the outer surface of the puck halves. The halves are locked together by an elastic snap-fastening means.

It is an object of the invention to provide a hockey puck for use on dry surfaces that simulates the performance of ice hockey pucks in all aspects of size and performance, including especially the ability to travel across the surface on which the puck is being used in a fashion similar to an ice hockey puck on ice. It is a further object of the invention to simulate the weight and feel of an ice hockey puck without added weights or other inserts within the puck body.

It is a further object of the invention to provide a road hockey puck that is easier to assemble and contains fewer components, yet is more durable and reliable than prior road hockey pucks.

Acknowledging that there is an inherent risk of injury attendant with the game of hockey, it is a further object of the invention to provide a road hockey puck that does not increase the likelihood of injuries to users due to the configuration of the puck itself, while minimizing the likelihood of damage to the surface on which the puck is being used.

Other objects and advantages of the invention will become apparent from the following detailed description and from the appended drawings in which like numbers have been used to describe like parts throughout the several views.

DESCRIPTION OF THE PREFERRED EMBODIMENT

Figure 1:
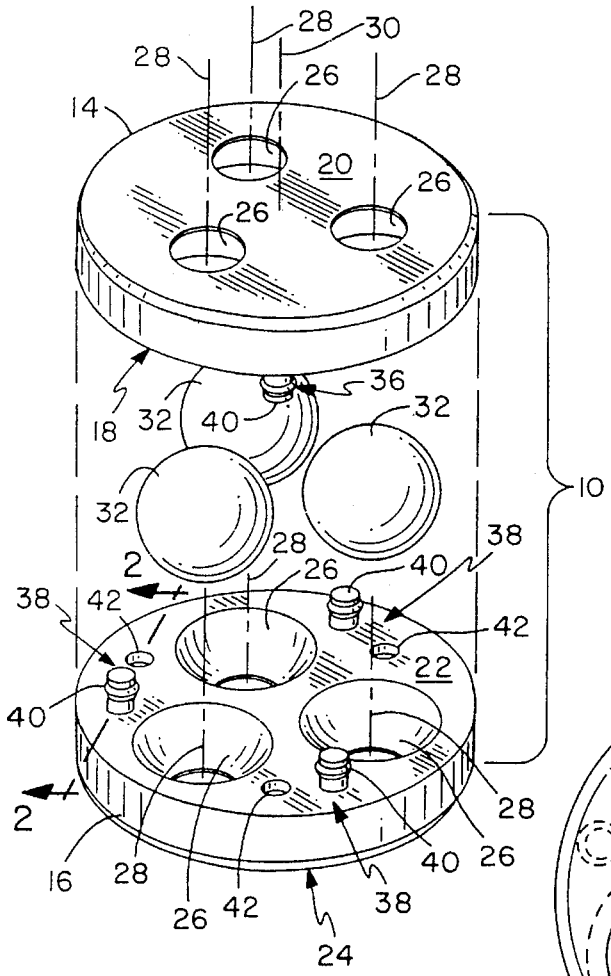
FIG. 1 shows an exploded perspective view of a hockey puck with integral rollers constructed according to the invention.

With reference to the drawings, and in particular to FIG. 1, the hockey puck having integral rollers is generally indicated by reference numeral 10. Hockey puck 10 includes a puck body 12 having a first cylindrical body half 14 and a second cylindrical body half 16.

First cylindrical body half 14 includes an inner face 18 and an outer face 20, and second cylindrical body half 16 includes an inner face 22 and an outer face 24. Body halves 14, 16 each include a plurality of truncated hemispherical cavities 26. In the preferred embodiment, there are three truncated hemispherical cavities 26 in each body half 14, 16. The equatorial plane of each truncated hemispherical cavity 26 is coplanar with inner faces 18, 22 of cylindrical body halves 14, 16. Each truncated hemispherical cavity 26 also defines a second, polar, latitudinal plane that is coplanar with the outer face 20, 24 of its respective cylindrical body half 14, 16. Truncated hemispherical cavities 26 have an axis 28 perpendicular to the planes defined by the inner and outer faces of cylindrical body halves 14, 16. Truncated hemispherical cavity axes 28 are parallel to the cylindrical axis 30 of puck body 12.

First and second cylindrical body halves 14, 16 each contain the same number of truncated hemispherical cavities 26. Each cavity 26 of first cylindrical body half 14 is positioned to oppose a cavity 26 of second cylindrical body half 16. Each opposably positioned pair of cavities 26 forms a generally spherical receptacle missing equal polar sections. In the preferred embodiment, each body half 14, 16 contains three such cavities 26. It is preferred that each cavity 26 be equally spaced from the next, adjacent cavity 26. In the preferred embodiment, then, truncated hemispherical cavity axes 28 would constitute the three vertices of an equilateral triangle. However, should there be four cavities 26 per cylindrical body half 14, 16, truncated hemispherical cavity axes 28 would constitute the four corners of a square. Similarly, should there be five cavities 26 per cylindrical body half 14, 16, truncated hemispherical cavity axes 28 would constitute the five points of an equilateral pentagon, and so on. In the preferred embodiment, first cylindrical body half 14 and second cylindrical body half 16 are identical components with equal dimensions throughout.

Figure 4:
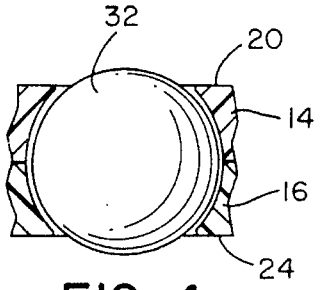
FIG. 4 shows a cross sectional view of the hockey puck taken along line 4—4 of FIG. 3.

As is most clearly shown in FIGS. 1 and 4, each receptacle formed by each pair of hemispherical cavities 26 contains a spherical ball element 32. Spherical ball element or roller 32 is preferably made of polypropelene.

Spherical ball element 32 should have a diameter between 1.125 inches and 1.5 inches, with a preferred diameter of approximately 1.25 inches. In the preferred embodiment, first cylindrical body half 14 and second cylindrical body half 16 are each approximately 0.5 inch thick and 3 inches in diameter. Thus, the overall height of an assembled puck body 12 is approximately one inch. It is also important that the radius of the truncated hemispherical cavities 26 is only slightly greater than one half the diameter of the rollers to be contained therein to prevent the introduction of foreign elements such as dirt and pebbles within the chamber containing ball elements 32. This is important because the introduction of foreign elements may inhibit the performance of hockey puck 10. Nevertheless, it is important that the radius of the cavities be large enough to permit free rotation of the rollers within the receptacles. The preferred radius for truncated hemispherical cavities 26 is approximately 0.656 inch. The preferred distance between hemispherical cavity axis 28 and puck body cylindrical axis 30 is approximately 0.77 inch. Given the one inch total thickness of puck body 12 and the preferred diameter of ball element 32 of 1.25 inches, the preferred embodiment of hockey puck 10 has ball element 32 projecting approximately 0.125 inch from first cylindrical body half outer face 20 and approximately 0.125 inch projecting from second cylindrical body half outer face 24.

Figure 3:
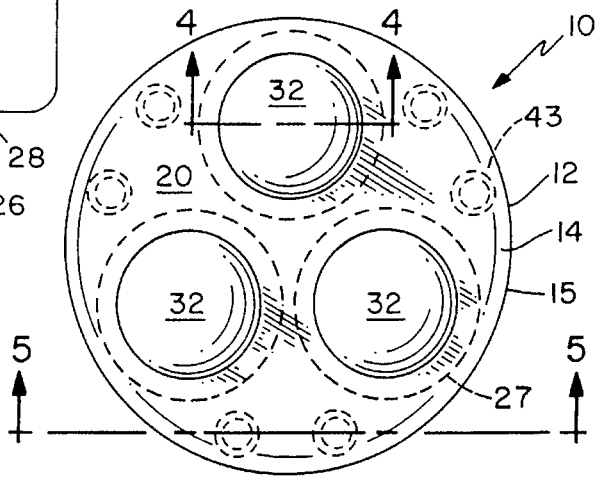
FIG. 3 shows a plan view of the hockey puck having integral rollers.
Figure 2:
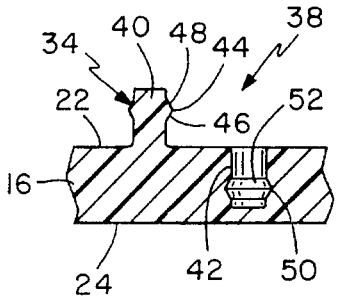
FIG. 2 shows a cross sectional view of the hockey puck taken along line 2—2 in FIG. 1.
Figure 5:
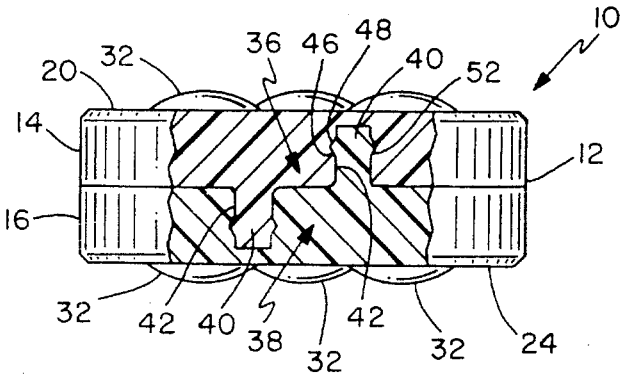
FIG. 5 shows a cross sectional view of the hockey puck taken along line 5—5 of FIG. 3.

As most clearly seen in FIG. 2, first cylindrical body half 14 and second cylindrical body half 16 are joined by elastic locking means 34. Elastic locking means 34 permits first cylindrical body half 14 and second cylindrical body half 16 to be releasably fastened together to form hockey puck body 12. Elastic locking means 34 includes at least one first elastic snap means 36 on inner face 18 of first cylindrical body half 14 and at least one second elastic snap means 38 on inner face 22 of second cylindrical body half 16. In the preferred embodiment, elastic locking means 34 includes three sets of first elastic snap means 36 and three sets of second elastic snap means 38. The number of first elastic snap means 36 must always equal the number of second elastic snap means 38. Each first elastic snap means 36 is matably opposed to a second elastic snap means 38. Elastic snap means 36, 38 each include a cylindrical projecting member 40 and a cylindrical receiving member 42. As shown in FIG. 3, in the preferred embodiment the distance between the circular edge 27 of the cavity 26 and the periphery 15 is the same as the distance between the outer most edge 43 of the receiving member 42 and the periphery 15. As shown in FIGS. 2 and 5, in the preferred embodiment projecting member 40 includes an extending, circumferential ring 44 having a first angled surface 46 and a second angled surface 48. Similarly, receiving member 42 includes a circumferential notch 50 for receiving circumferential ring 44 of projecting member 40. Circumferential notch 50 has a restraining surface 52 against which first angled surface 46 of circumferential ring 44 bears when projecting member 40 is fully inserted within receiving member 42. Projecting member 40 of a first elastic snap means 36 is matably opposed to receiving member 42 of a complementary second elastic snap means 38, permitting projecting member 40 to be received within receiving member 42 when first cylindrical body half 14 is joined to second cylindrical body half 16 to form hockey puck body 12.

It is preferred that first and second cylindrical body halves 14, 16 be molded of a resilient material such as polyurethane. The preferred polyurethane is TEXIN 688A supplied by Mobay Consolidated Plastics. When manufactured of the specified materials, hockey puck 10 weighs approximately 132 grams, or slightly less than six ounces. While weighing slightly less than a regulation ice hockey puck (approximately 161 grams), hockey puck 10 still has adequate mass to provide the momentum needed to overcome the friction forces opposing the rolling motion of ball elements 32. Further, players using hockey puck 10 on surfaces such as roads or gym floors frequently do not wear the padding worn by ice hockey players, and the slightly reduced mass helps lighten the blow received by a player whose body may be struck by a flying puck 10. Another advantage of the specified materials is that a hockey puck 10 may be manufactured in a variety of colors, rendering hockey puck 10 more pleasing to the eye, as well as easier to see on dark surfaces such as asphalt roads. In the preferred embodiment, each projecting member 40 is unitary with its respective body half 14, 16. That is to say, projecting member 40 is molded of the same material and in the same step as its respective body half 14, 16. Likewise, circumferential ring 44 of projecting member 40 is unitary with projecting member 40 and thereby unitary with its respective body half 14, 16.

Hockey puck 10 of this invention is easy to assemble. First, with second cylindrical body half 16 horizontally oriented with inner face 22 upwardly oriented and outer face 24 downwardly oriented, as shown in FIG. 1, a ball element 32 is located in each of the three truncated hemispherical cavities 26 of second cylindrical body half 16. Next, first cylindrical body half 14 is positioned above second cylindrical body half 16 containing ball elements 32, and each of the three sets of first elastic snap means 36 are fastened to second elastic snap means 38 by aligning projecting member 40 of first elastic snap means 36 with receiving member 42 of a corresponding second elastic snap means 38. Simultaneously, projecting members 40 of second elastic snap means 38 will be aligned with receiving members 42 of corresponding first elastic snap means 36. First cylindrical body half 14 and second cylindrical body half 16 are then pressed together and join to form hockey puck 10. The resilient nature of the material used to make cylindrical body halves 14, 16 permits some compression of circumferential ring 44 and some expansion of the walls of receiving member 42, allowing complete insertion of projecting member 40 within receiving member 42. Care must be taken to ensure that each projecting member 40 is fully inserted within receiving member 42 for the most complete fastening of the first and second body halves 14, 16. Circumferential ring 44 of projecting member 40 must be completely received within circumferential notch 50 of receiving member 42 to assure that restraining surface 52 of circumferential notch 50 fully bears against first angled surface 46 of circumferential ring 44.

In use, hockey puck 10 may be used on any hard surface such as the asphalt or concrete frequently found on streets, outdoor basketball courts, tennis courts and other flat outdoor surfaces. Alternatively, hockey puck 10 may be used on such indoor surfaces as the floors of gymnasiums and other large recreational halls. Hockey puck 10 may be used just as an ordinary hockey puck in games simulating ice hockey where the participants may wear in-line roller skates or other footwear suitable for such activity. When propelled along the surface on which the game is being played, the ball elements or rollers 32 of hockey puck 10 rotate freely within the generally spherical chamber or receptacle formed by each pair of truncated hemispherical cavities 26. The rotating action of rollers 32 within hockey puck 10 overcomes the frictional resistance that would otherwise be encountered by puck body 12 as hockey puck 10 travels along the surface on which the game is being played. In the event that foreign material such as dirt becomes lodged within the receptacles surrounding ball elements 32, the dirt may be flushed out with a garden hose or other source of running water.

While the preferred embodiments of the invention have been described, it should be understood that various changes, adaptations, and modifications may be made therein without departing from the spirit of the invention and the scope of the appended claims.

What is claimed is:

1. A hockey puck comprising:

a body comprising a first cylindrical body half and a second cylindrical body half, said first cylindrical body half and said second cylindrical body half each having an inner face, an outer face and a periphery;

at least three opposing pairs of equal, truncated hemispherical cavities, each said pair of truncated hemispherical cavities forming a receptacle, each said pair including a first truncated hemispherical cavity contained in said first cylindrical body half and a second truncated hemispherical cavity contained in said second cylindrical body half and each forming a circular edge at its intersection with the plane of the inner face, the equatorial plane of each said truncated hemispherical cavity being coplanar with said inner face of said first and second cylindrical body halves, each of said truncated hemispherical cavities having a diameter along said equatorial plane, each said truncated hemispherical cavity further having an axis perpendicular to the planes defined by said inner and outer faces of said cylindrical body halves, said axis of each said truncated hemispherical cavity spaced an equal distance from said axis of each adjacent said truncated hemispherical cavity;

spherical ball elements contained within said receptacles;

a plurality of elastic snap assemblies, said elastic snap assembly comprising a first projecting member on said inner face of said first cylindrical body half, a second projecting member on said inner face of said second cylindrical body half, a first receiving member on said inner face of said first cylindrical body half and a second receiving member on said inner face of said second cylindrical body half, whereby said first projecting member is matably opposed to said second receiving member to be securely and releasably received therein, and said second projecting member is matably opposed to said first receiving member to be securely and releasably received therein, a combination of said first projecting member and said first receiving member, and a combination of said second projecting member and said second receiving member defining an elastic fastening pair on said first and second cylindrical body halves respectively, said receiving members defining an outer most edge on said inner face of said halves, each one of said projecting and receiving members of said elastic fastening pair being positioned in close proximity to each other around the periphery of said halves in an alternating pattern such that each one of said elastic fastening pair being located on either side of an adjacent pair of said receptacles formed by said truncated hemispherical cavities, and whereby said first cylindrical body half and said second cylindrical body half may be subjected to uniform distribution of separation forces through said elastic fastening pairs, the distance between the outer most reach of each circular edge and the periphery being equal to the distance between the outer most edge of each receiving member and the periphery.

2. A hockey puck as defined in claim 1, wherein said first and second projecting members and said first and second receiving members are cylindrical and said elastic snap assemblies further comprise:

a first extending circumferential ring projecting from an intermediate portion of said first projecting member;

a second extending circumferential ring projecting from an intermediate portion of said second projecting member;

a first circumferential notch extending into said second cylindrical body half from an intermediate portion of said first receiving member; and a second circumferential notch extending into said first cylindrical body half from an intermediate portion of said second receiving member, whereby, upon releasably fastening said elastic snap assemblies of said first and second cylindrical body halves, respectively, said first extending circumferential ring of said first projecting member matably engages said first circumferential notch of said first receiving member and said second extending circumferential ring of said second projecting member matably engages said second circumferential notch of said second receiving member.

3. A hockey puck as defined in claim 2, wherein said elastic snap assemblies further comprise:

a generally flat angled surface on each of said first and second extending circumferential rings; and a generally flat restraining surface on each of said first and second circumferential notches, said angled surface beating against said restraining surface upon releasably fastening said elastic snap assemblies, said restraining surface tending to restrict the outward motion of said projecting members from said receiving members.

4. A hockey puck as defined in claim 1 wherein the height of said body is less than or equal to one inch; and the diameter of each said spherical ball element is greater than 1.125 inches and less than or equal to 1.5 inches.

5. A hockey puck as defined in claim 4, wherein:

the diameter of each said spherical ball element is approximately 1.25 inches.

* * * * *